US010224018B2

(12) United States Patent
Woelfl et al.

(10) Patent No.: US 10,224,018 B2
(45) Date of Patent: Mar. 5, 2019

(54) ARRANGEMENTS AND METHODS FOR ACTIVE NOISE CANCELLING

(71) Applicant: Harman Becker Automotive Systems GmbH, Karlsbad (DE)

(72) Inventors: Genaro Woelfl, Salching (DE); Matthias Kronlachner, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/860,546

(22) Filed: Jan. 2, 2018

(65) Prior Publication Data

US 2018/0190259 A1 Jul. 5, 2018

(30) Foreign Application Priority Data

Jan. 4, 2017 (EP) ..... 17150264

(51) Int. Cl.
*G10K 11/16* (2006.01)
*G10K 11/178* (2006.01)
(Continued)

(52) U.S. Cl.
CPC ..... *G10K 11/17815* (2018.01); *G10K 1/38* (2013.01); *G10K 11/17827* (2018.01);
(Continued)

(58) Field of Classification Search
CPC ..... G10K 11/17815; G10K 2210/1081; G10K 2210/128; G10K 2210/3026;
(Continued)

(56) References Cited

U.S. PATENT DOCUMENTS 4,977,600 A 12/1990 Ziegler
7,466,838 B1 12/2008 Moseley
(Continued)

OTHER PUBLICATIONS

European Patent Office, Extended European Search Report Issued in Application No. 17209914.5, dated May 4, 2018, Germany, 10 pages.

(Continued)

*Primary Examiner* — Andrew L Sniezek
(74) *Attorney, Agent, or Firm* — McCoy Russell LLP

(57) ABSTRACT

A loudspeaker arrangement comprises a first loudspeaker configured to radiate an acoustical signal, and a first microphone that is acoustically coupled to the first loudspeaker via a secondary path and that is electrically coupled to the first loudspeaker via an active noise control processing unit. During the use of the loudspeaker arrangement, the first loudspeaker is arranged at a first distance from a first active noise control target position, wherein the first active noise control target position is a position at which noise is to be suppressed, and wherein the first distance is a length of the shortest path between the first loudspeaker and the first active noise control target position through free air. The first microphone is arranged at a second distance from the first loudspeaker that equals the first distance, and the position of the first microphone differs from the first active noise target position.

16 Claims, 2 Drawing Sheets

FIG 3

(51) Int. Cl.

| | |
|---|---|
| ***H04R 1/02*** | (2006.01) |
| ***H04R 5/033*** | (2006.01) |
| ***H04S 5/02*** | (2006.01) |
| ***H04S 7/00*** | (2006.01) |
| ***H04R 5/04*** | (2006.01) |
| ***H04S 3/00*** | (2006.01) |
| ***H04R 1/10*** | (2006.01) |
| ***H04R 3/02*** | (2006.01) |
| ***G10K 1/38*** | (2006.01) |
| ***H04R 5/02*** | (2006.01) |

(52) U.S. Cl.
CPC ..... *G10K 11/17881* (2018.01); *H04R 1/028* (2013.01); *H04R 1/1008* (2013.01); *H04R 1/1083* (2013.01); *H04R 3/02* (2013.01); *H04R 5/02* (2013.01); *H04R 5/033* (2013.01); *H04R 5/04* (2013.01); *H04S 3/008* (2013.01); *H04S 5/02* (2013.01); *H04S 7/304* (2013.01); *H04S 7/306* (2013.01); *G10K 11/178* (2013.01); *G10K 2210/1081* (2013.01); *G10K 2210/128* (2013.01); *G10K 2210/3026* (2013.01); *G10K 2210/3044* (2013.01); *G10K 2210/3046* (2013.01); *H04R 2205/022* (2013.01); *H04R 2460/01* (2013.01); *H04R 2499/13* (2013.01); *H04S 2400/01* (2013.01); *H04S 2400/11* (2013.01); *H04S 2420/01* (2013.01)

(58) Field of Classification Search
CPC ... G10K 2210/2044; G10K 2210/3046; H04R 1/028; H04R 2499/13
See application file for complete search history.

(56) References Cited

U.S. PATENT DOCUMENTS

| | | | | |
|---|---|---|---|---|
| 9,648,410 | B1 * | 5/2017 | Kratsas | H04R 1/1041 |
| 2008/0317254 | A1 * | 12/2008 | Kano | G10K 11/178 381/71.4 |
| 2012/0215519 | A1 | 8/2012 | Park et al. | |
| 2016/0027428 | A1 * | 1/2016 | Gul | G10K 11/1788 381/71.4 |
| 2016/0353197 | A1 * | 12/2016 | Ring | G10K 11/1784 |
| 2016/0372104 | A1 | 12/2016 | Nystrom | |

OTHER PUBLICATIONS

Woelfl, G. et al., "Systems and Methods for Generating Natural Directional Pinna Cues for Virtual Sound Source Synthesis," U.S. Appl. No. 15/860,451, filed Jan. 2, 2018, 120 pages.
Woelfl, G., "Arrangements and Methods for 3D Audio Generation," U.S. Appl. No. 15/860,468, filed Jan. 2, 2018, 60 pages.
Woelfl, G. et al., "Arrangements and Methods for Generating Natural Directional Pinna Cues," U.S. Appl. No. 15/860,489, filed Jan. 2, 2018, 61 pages.

* cited by examiner

ARRANGEMENTS AND METHODS FOR ACTIVE NOISE CANCELLING

CROSS REFERENCE TO RELATED APPLICATIONS

The present application claims priority to European Patent Application No. EP17150264.4 entitled "ARRANGEMENTS AND METHODS FOR GENERATING NATURAL DIRECTIONAL PINNA CUES", and filed on Jan. 4, 2017. The entire contents of the above-listed application are hereby incorporated by reference for all purposes.

TECHNICAL FIELD

The disclosure relates to arrangements and methods for active noise and distortion cancelling, in particular for active noise and distortion cancellation in headphones and other devices configured to position sound sources close to the ears of a user.

BACKGROUND

Active noise cancelling (ANC), also known as active noise cancellation, active noise control or active noise reduction (ANR) is often used in headphone applications. ANC is used to suppress noise that is generated by the environment of the user and which might reduce the user's musical enjoyment or generally conflict with a user's desire for silence. For feedback ANC, usually a feedback microphone is arranged close to a loudspeaker. The microphone receives a sum signal including a sound signal radiated by the loudspeaker as well as any unwanted noise from external sources. The loudspeaker may radiate desired sound signals (e.g., music or any other acoustic signal), which may be linearly distorted (e.g., amplitude and phase response alterations), as well as harmonic and nonlinear distortion products and noise. Information about the noise from external sources as well as from the loudspeaker, distortion products from the loudspeaker and any linear distortion that may be applied to a desired sound signal by the loudspeaker, may be obtained by subtracting the desired sound signal from the sum signal. A noise and distortion reducing signal may then be emitted which has the same amplitude but an inverted phase as compared to the noise and distortion signal. By superimposing the noise and distortion signal and the noise and distortion reducing signal, the resulting difference signal between the desired sound signal and the sum signal picked up by the microphone, also known as error signal, ideally tends towards zero. ANC and distortion compensation systems generally perform well for traditional headphones which create a pressure chamber around the ear. However, problems arise in open or semi-open headphones or, generally, in any sound devices which do not form a pressure chamber around the user's ear.

SUMMARY

A loudspeaker arrangement includes a first loudspeaker configured to radiate an acoustical signal, and a first microphone that is acoustically coupled to the first loudspeaker via a secondary path and that is electrically coupled to the first loudspeaker via an active noise control processing unit. During the use of the loudspeaker arrangement, the first loudspeaker is arranged at a first distance from a first active noise control target position, wherein the first active noise control target position is a position at which noise is to be suppressed, and wherein the first distance is a length of the shortest path between the first loudspeaker and the first active noise control target position through free air. The first microphone is arranged at a second distance from the first loudspeaker, wherein the second distance is a length of the shortest path between the first loudspeaker and the first microphone through free air. The first distance equals the second distance, and the position of the first microphone is remote from the first active noise target position.

A method includes radiating an acoustical signal at a first position, wherein a first active noise control target position is arranged at a first distance from the first position, wherein the active noise target position is the position at which noise is to be suppressed, and wherein the first distance is a length of the shortest path of the acoustical signal to the active noise control target position through free air. The method further includes detecting sound at a second position, wherein the second position is arranged at a second distance from the first position, wherein the second distance is a length of the shortest path of the sound to the second position through free air. The first distance equals the second distance.

Other systems, methods, features and advantages will be or will become apparent to one with skill in the art upon examination of the following detailed description and figures. It is intended that all such additional systems, methods, features and advantages be included within this description, be within the scope of the disclosure and be protected by the following claims.

BRIEF DESCRIPTION OF THE DRAWINGS

The method may be better understood with reference to the following description and drawings. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Figure 1:
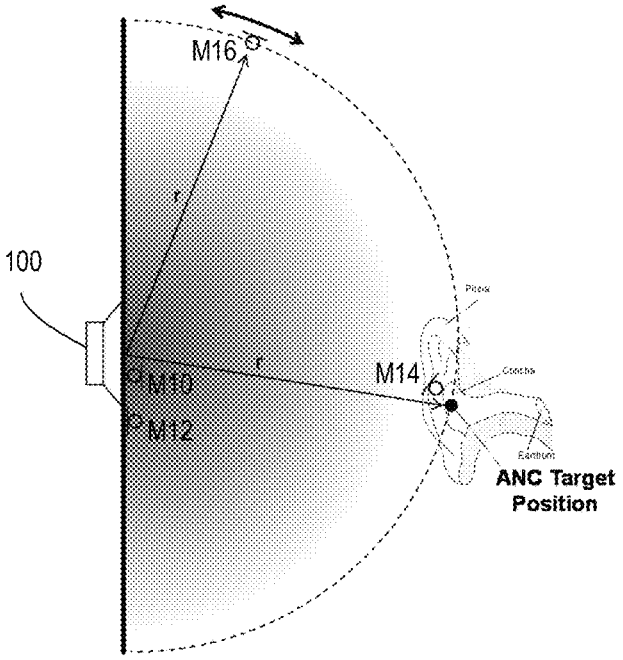
FIG. 1 schematically illustrates a loudspeaker arranged at a certain distance from a user's ear and different microphone positions for active noise cancelling.

In the following detailed description, reference is made to the accompanying drawings. The drawings show specific examples in which the disclosure may be practiced. It is to be understood that the features and principles described with respect to the various examples may be combined with each other, unless specifically noted otherwise. In the description as well as in the claims, designations of certain elements as "first element", "second element", "third element" etc. are not to be understood as enumerative. Instead, such designations serve solely to address different "elements". That is, e.g., the existence of a "third element" does not require the existence of a "first element" and a "second element".

Active noise cancelling (ANC), also known as active noise cancellation or active noise reduction (ANR), based on microphone feedback is often applied in headphones to suppress environment noise. ANC systems are usually intended to reduce or even cancel a disturbing signal, such as externally generated noise as well as loudspeaker distortion and noise, by providing at a listening site a noise reducing signal that ideally has the same amplitude over time but the opposite (inverted) phase as compared to the noise and distortion signal. By superimposing the noise and distortion signal and the noise and distortion reducing signal, the noise signal is cancelled out resulting in a difference signal representing a difference between the desired sound signal and the sum signal picked up by the microphone, also known as error signal, which ideally tends towards zero. A microphone may detect a sum signal which includes the desired acoustical signal (sound signal) as well as unwanted noise and distortion. As the desired acoustical signal is known, the desired acoustical signal is subtracted from the sum signal, which leaves the unwanted noise and distortion. Once information about the noise is available, the noise reducing signal may be created accordingly.

Especially in headphones, a feedback microphone is usually placed close to the loudspeaker over which the anti-noise signal for noise cancellation is emitted. The reason for placing the feedback microphone close to the loudspeaker is that the sound that is emitted by the loudspeaker membrane travels through the air until it reaches the microphone. This distance between the loudspeaker membrane and the microphone causes phase shifts. The phase shifts may be minimized for microphone positions close to the loudspeaker membrane, thereby improving stability of the feedback loop and extending the frequency range for which amplification may be applied within the open feedback loop. Traditional (closed back) headphones create a pressure chamber around the ear. The loudspeaker and the feedback microphone are arranged within the pressure chamber. For this type of headphones it may be advantageous to place the microphones close to the loudspeaker. However, for open or semi-open sound fields the traditional microphone position may not be advantageous, especially if the loudspeaker is positioned at a certain distance from the position at which noise cancellation shall be effective. This is because in open or semi-open sound fields the sound pressure level (SPL) decreases with an increasing distance from the loudspeaker. Open headphone and headset arrangements, for example, do not create a pressure chamber around the ear. This means that the feedback microphone is arranged in a semi-open sound field (the sound field is only partly enclosed by the support structure of an open ear cup). As a result, the sound pressure level of sound radiated by a loudspeaker utilized for active noise suppression changes substantially over varying distances from the loudspeaker. Especially at low frequencies (high wavelength as compared to the dimensions of the audio device), the amplitude variation effects caused by differences in distance between loudspeakers utilized for active noise suppression and feedback microphones as well as target positions for active noise suppression by far outweigh any phase variation effects with regard to their impact on active noise suppression performance. Therefore, an improved microphone placement is provided herein. The microphone placement is adapted as compared to known closed headphone arrangements with the microphone arranged close to the loudspeaker, as has been described above.

Within an open sound field (open sound field means that there are no bordering elements within a distance of a sound source that is small as compared to the wavelength of the frequencies of interest), when the distance from the source doubles, the sound pressure level (SPL) decreases by about 6 dB. In semi-open sound fields (semi-open sound field means that there are some boundaries arranged around the sound source within a distance from the sound source that is small as compared to the wavelength of the frequencies of interest), the sound pressure level (SPL) decrease is lower as compared to an open sound field, but may still be about 3 dB or higher for a doubling of the distance from the source. FIG. 1 schematically illustrates a loudspeaker arrangement, wherein the user's ear is located at a certain distance from the loudspeaker 100. The distance between the loudspeaker 100 and the user's ear may be several centimeters. For example, the distance may be less than 30 cm, less than 20 cm, less than 10 cm or less than 5 cm. A first and a second feedback microphone M10, M12 are located at a first and second distance in front of the loudspeaker 100. The first and second feedback microphones M10, M12 may be arranged in close proximity to (e.g., several centimeters away from) the loudspeaker 100, for example. According to one example, the first distance and the second distance are less than 2 cm, less than 1 cm or less than 0.5 cm. As the first and second feedback microphones M10, M12 are arranged close to the loudspeaker 100, they receive a sound pressure level of the sound that is generated by the loudspeaker 100 that is much higher than the sound pressure level that is received at the location of the ear, as the ear is located much further away from the loudspeaker 100 than the feedback microphones M10, M12. A third feedback microphone M14 is positioned at a third position, which may be referred to as ANC (active noise cancelling) target position. This third position is located at or close to the entrance of the ear canal. For example, a distance between the entrance of the ear canal and the third feedback microphone M14 may be less than 2 cm, less than 1 cm or less than 0.5 cm. The ANC target position generally is the position for which noise should be suppressed. The third feedback microphone M14, therefore, receives a sound pressure level of the sound emitted by the loudspeaker 100 that is (almost) the same as the sound pressure level that is received by the ear. A fourth feedback microphone M16 is located at a fourth position. The fourth position is located on a radius r around the frontal side of the loudspeaker membrane. The radius r essentially equals the distance between the loudspeaker 100 and the entry of the ear canal (ANC target position). For all positions that are located on this radius r, the sound pressure level (SPL) from the loudspeaker 100 is approximately equal. This applies in particular for loudspeakers having a loudspeaker membrane that is small as compared to the wavelength of the radiated sound.

It should be noted, that the radius r (distance between the loudspeaker 100 and the ANC target position/distance between the loudspeaker 100 and the fourth feedback microphone M16) does not necessarily refer to a straight line between the loudspeaker 100 and the ANC target position/feedback microphone M16. The radius r rather describes a distance (shortest path) the sound waves emanated by the loudspeaker 100 have to travel through free air in order to reach the ANC target position or the feedback microphone. Obstacles in the direct path may increase the actual distance the sound needs to travel. In this regard, porous materials, fabrics and similar materials may be considered as obstacles if the sound has to travel an increased distance when passing through these materials. The increase in distance, however, may be negligible if it is small as compared to the complete path length. The same applies for the exemplary embodiments described further below.

When anti-noise signals are generated by the loudspeaker 100 by means of a feedback of the signal picked up by respective feedback microphones, a silent zone is created that includes the feedback microphone position. If noise cancellation is applied by means of feedback, the anti-noise signal that is received at the position of the feedback microphones is about equal in sound pressure level to the external noise signal and inverted in phase. If the anti-noise signal has an equal sound pressure level as compared to the external noise signal at the positions of the first and second feedback microphones M10 or M12, the sound pressure level of the anti-noise signal will have decreased substantially until the anti-noise signal reaches the ANC target position. Therefore, the sound pressure level of the anti-noise signal at the ANC target position may not be strong enough to facilitate a significant noise reduction. If the sound pressure level of the anti-noise signal is essentially equal to the sound pressure level of the external noise signal at the positions of the third and/or fourth feedback microphone M14 or M16, noise cancellation will be at an optimum at the ANC target position. This is schematically illustrated in FIG. 1. It should be noted that the sound pressure level of unwanted noise and distortion (not anti-noise) generated by a loudspeaker that is part of a feedback loop will decrease with approximately the same rate over an increasing distance from the loudspeaker as any anti-noise signal emitted by the same loudspeaker. Therefore, the distance of the microphone from the loudspeaker is not relevant if only noise and distortion generated by that loudspeaker (no noise from external noise sources) are to be cancelled.

Figure 2:
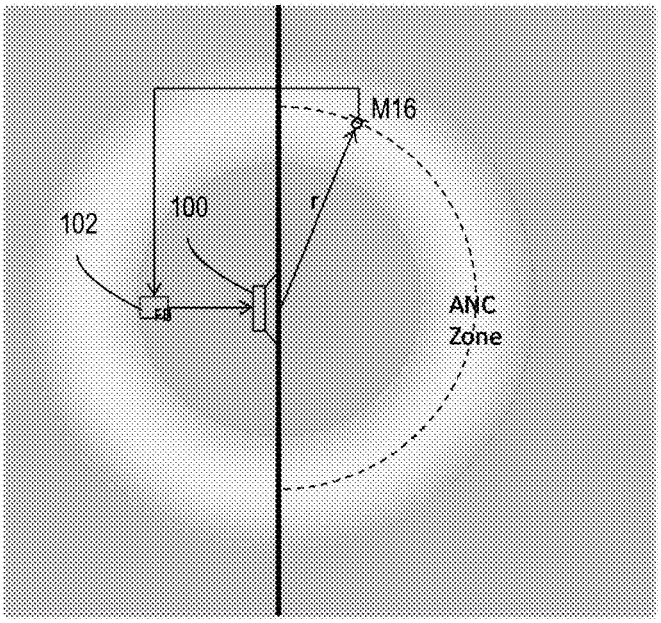
FIG. 2 schematically illustrates an active noise cancelling zone around a loudspeaker.

Referring to FIG. 2, sound pressure levels of the unwanted noise are the lowest along the radius r, the radius r including the fourth position of the fourth feedback microphone M16. In the example of FIG. 2, the ANC feedback loop comprises the fourth feedback microphone M16 and the loudspeaker 100. The fourth feedback microphone M16 is configured to provide a feedback signal for the ANC feedback loop. The feedback loop further comprises an ANC processing unit 102 that may be configured to receive the feedback signal, process the feedback signal and generate an anti-noise signal based on the received feedback signal. The loudspeaker 100 is configured to radiate an acoustical signal. The fourth feedback microphone M16 is acoustically coupled to the loudspeaker 100 via a secondary path and is electrically coupled to the loudspeaker 100 via the active noise control processing unit 102. During the use of the arrangement the loudspeaker 100 is arranged at a first distance r from the active noise control target position and the fourth feedback microphone M16 is arranged at a second distance r from the loudspeaker 100, wherein the first distance r equals the second distance r.

For active noise cancellation (ANC) one or multiple feedback microphones could be positioned close to the ANC target position (e.g. entry of ear canal). In a headphone arrangement, however, especially in an open headphone arrangement, it may be difficult to arrange a feedback microphone at the entrance of the ear canal. This would require special mounting systems which protrude into the otherwise open headphone structure. A feedback microphone could be held in place close to the ear canal using a bar that is coupled to a support structure of an open ear cup of the headphone arrangement, for example. Other mounting systems may include any kind of cords that are coupled to the open ear cup to hold the feedback microphone in place. Such mounting systems, however, may be disturbing and may be easily damaged. Furthermore, such mounting systems may cause reflections. Such reflections, however, are detrimental for the generation of natural directional pinna cues, for example. Another drawback is that a protruding microphone mounting system may not meet design targets of a headphone arrangement, as it blocks the open view onto the ear which may be considered important for a new headphone category that is completely open. Therefore, according to an embodiment of the present disclosure, one or more feedback microphones are arranged at one or multiple positions that have essentially the same distance from the loudspeaker as the ANC target location. The ANC target location may be the ear canal, in particular the entrance of the ear canal, for example. According to one example of the present disclosure, one or more feedback microphones are positioned within the frontal hemisphere of the loudspeaker membrane.

Figure 3:
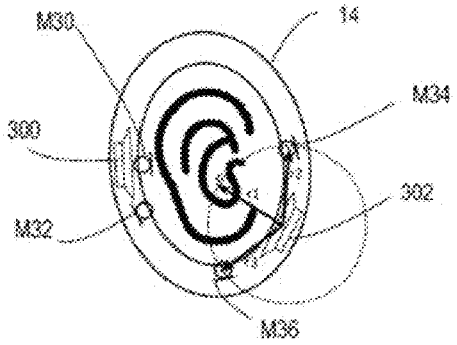
FIG. 3 schematically illustrates an open ear cup with loudspeakers and microphones arranged thereon.

This is exemplarily illustrated in FIG. 3. The headphone arrangement of FIG. 3 comprises a first loudspeaker 300 and a second loudspeaker 302 that are arranged on the support structure 14 of an open ear cup. The support structure 14 of the open ear cup defines an open volume about the ear of the user, when the support structure 14 is arranged around the ear of the user. The support structure 14 may be included in an open ear cup. However, it is also possible that the support structure 14 is included in an open headphone, a virtual reality headset, or an augmented reality headset, for example. A first feedback microphone M30 and a second feedback microphone M32 are arranged in close proximity to the first loudspeaker 300. This resembles the arrangement as has been described above, with the distance between the first loudspeaker 300 and the first and second feedback microphones M30, M32 being less than 1 cm, or less than 0.5 cm, for example. An ANC feedback loop that comprises the first loudspeaker 300 and a first feedback microphone M30 and a second feedback microphone M32 that are arranged in such close proximity to the first loudspeaker 300 may not cancel unwanted noise originating from external sources at the ANC target position c (at the entrance to the ear canal).

The second loudspeaker 302 is arranged on the support structure of the ear cup 14 at a first distance r1 from the ANC target position, wherein the first distance r1 is a length of the shortest path between the second loudspeaker 302 (or, more precisely, the acoustic center of the second loudspeaker 302) and the active noise control target position through free air (acoustically unobstructed path). A third feedback microphone M34 and a fourth feedback microphone M36 are arranged on the support structure of the open ear cup 14. A second distance r2 between the second loudspeaker 302 and the third feedback microphone M34 (length of the shortest path between the second loudspeaker 302 and the third feedback microphone M34 through free air) and a third distance r3 between the second loudspeaker 302 and the fourth feedback microphone M36 (length of the shortest path between the second loudspeaker 302 and the fourth feedback microphone M36 through free air) are equal to the first distance r1 (r1=r2=r3). In other words, the third and fourth feedback microphones M34, M36 as well as the ANC target position c may be arranged on the perimeter of a sphere having a first radius r1 around the second loudspeaker 302. The second loudspeaker 302 may form one or more feedback loops with one or more of the third and fourth feedback microphone M34, M36. For example, a feedback loop may comprise the second loudspeaker 302 and the third feedback microphone M34, or a feedback loop may comprise the second loudspeaker 302 and the fourth feedback microphone M36 of FIG. 3, for example. According to another example, a feedback loop may comprise both the third and the fourth feedback microphone M34 and M36 and the second loudspeaker 302 of FIG. 3. Therefore, the signal picked up by the third feedback microphone M34 may be added to the signal picked up by the fourth feedback microphone M36 and the sum signal may be utilized for further processing within the feedback loop. Such a feedback loop may further comprise other optional signal conditioning and processing units (not illustrated in FIG. 3). For example, the feedback loop may further comprise at least one microphone pre-amplifier, at least one analog to digital converter, at least one digital signal processor, at least one digital to analog converter and/or at least one amplifier. Within the digital signal processor, the difference between a representation of a desired signal and a representation of a signal originally picked up by a feedback microphone, amplified by a microphone pre-amplifier and converted to a digital signal by a digital to analog converter, may be calculated. Furthermore, at least one filter (e.g. loop filter) may be applied to a resulting difference signal. The filtered difference signal may then be applied to the loudspeaker via a digital to analog converter and an amplifier. These are however only examples, that are not meant to restrict the scope of the disclosure in any sense. Each feedback loop may comprise an active noise control processing unit. An active noise control processing unit may comprise one or more of the above mentioned signal conditioning and processing units (e.g., microphone pre-amplifier, analog to digital converter, amplifier, etc). Each feedback loop may comprise a separate active noise control processing unit. It is, however, also possible that two or more feedback loops share an active noise control processing unit. An active noise control processing unit may be configured to receive at least one input signal from at least one microphone, subtract the input signal from a desired signal to receive an error signal, apply at least one filter to the error signal, and provide the filtered error signal as a driving signal to at least one loudspeaker. A multitude of possible ANC feedback loop implementations are known in the art and will not be described here in further detail.

The proposed feedback microphone arrangement may be used for an open or semi-open headphone arrangement. The proposed feedback microphone arrangement may further be used for a headset arrangement for virtual reality or augmented reality applications, for example.

Figure 4:
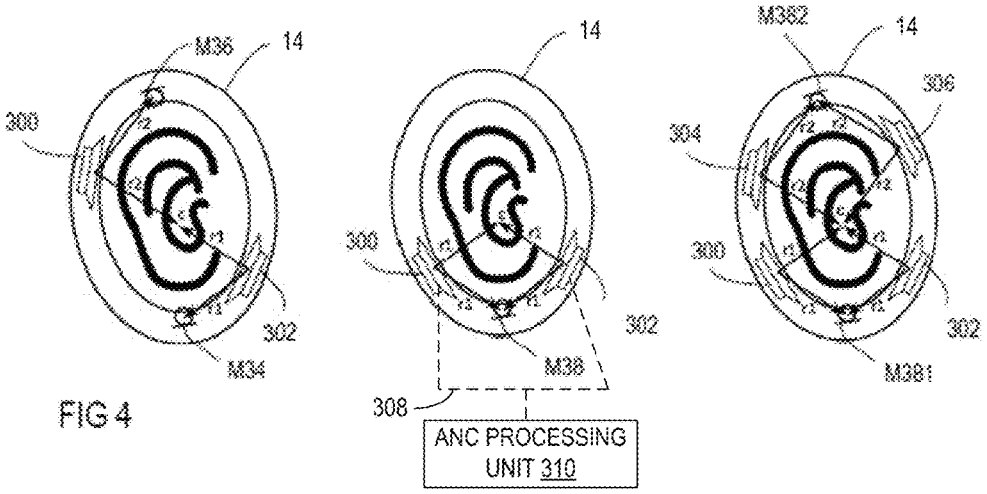
FIG. 4 schematically illustrates arrangements including a plurality of loudspeakers.

FIG. 4 schematically illustrates various embodiments with two or more loudspeakers. According to a first embodiment (FIG. 4, left side) the arrangement includes a first loudspeaker 300 and a second loudspeaker 302. The arrangement further includes a third feedback microphone M34 and a fourth feedback microphone M36. The third feedback microphone M34 is arranged at a certain distance r1 from the second loudspeaker 302. This distance r1 equals the distance between the second loudspeaker 302 and the ANC target position. The fourth feedback microphone M36 is arranged at a certain distance r2 from the first loudspeaker 300. This distance r2 equals the distance between the first loudspeaker 300 and the ANC target position. The distance r2 between the first loudspeaker 300 and the ANC target position does not necessarily have to be equal to the distance r1 between the second loudspeaker 302 and the ANC target position. The first loudspeaker 300 may be combined with the fourth feedback microphone M36 to form a feedback loop, and the second loudspeaker 302 may be included in another feedback loop together with the third feedback microphone M34, for example. If both feedback loops are operated simultaneously, however, it may be preferable in some cases that the target positions of the two feedback loops are not identical, as anti-noise signals of both loops may otherwise superimpose at a common ANC target position. This may lead to an over-compensation of the noise signal, which may further result in a reduced noise suppression (as compared to a single feedback loop), or even a boost of noise. The reason for this is that the remote third and fourth feedback microphones M34 and M36 of FIG. 4, left side, each may primarily receive signals from the loudspeaker that is arranged closer to the respective feedback microphone M34, M36. To avoid over-compensation, the ANC target positions of both feedback loops may be chosen remotely from each other and remotely from the actual ANC target position of the complete ANC system (e.g. the ear canal entry in FIG. 4, left side). These remote ANC target positions may, for example, be chosen such that the distance between each loudspeaker 300, 302 within a feedback loop and the remote target position equals half of the distance of each loudspeaker 300, 302 within that feedback loop to the actual ANC target position (e.g. entry of the ear canal).

According to a further exemplary embodiment (FIG. 4, middle), the arrangement may include a first loudspeaker 300, a second loudspeaker 302 and only one feedback microphone M38. The feedback microphone M38 may be arranged such that a distance between the feedback microphone and the first loudspeaker 300 equals a distance between the feedback microphone M38 and the second loudspeaker 302. Further, the distance between the feedback microphone and each of the loudspeakers 300, 302 equals the distance between each of the loudspeakers 300, 302 and the ANC target position. In this way, only one feedback microphone may be used in two different feedback loops, namely a first feedback loop including the first loudspeaker 300 and the feedback microphone M38, and a second feedback loop including the second loudspeaker 302 and the feedback microphone M38. Alternatively, both loudspeakers 300, 302 may also be used in a single feedback loop with the feedback microphone M38, wherein both loudspeakers receive an identical control signal (e.g., control signal 308 from ANC processing unit 310) at least over a limited frequency range.

According to an even further embodiment (FIG. 4, right side), the arrangement includes more than two loudspeakers. For example, the arrangement may include a first loudspeaker 300, a second loudspeaker 302, a third loudspeaker 304 and a fourth loudspeaker 306. In the third example illustrated in FIG. 4, the arrangement further includes two feedback microphones M381, M382. One of the feedback microphones M381 is arranged between the first loudspeaker 300 and the second loudspeaker 302 such that a distance between the first loudspeaker 300 and the feedback microphone M381 equals a distance between the second loudspeaker 302 and the feedback microphone M381. Further, the distances between the feedback microphone M381 and each of the first and second loudspeakers 300, 302 equal the distances between each of the first and second loudspeaker 300, 302 and the ANC target position. The other feedback microphone M382 is arranged between the third loudspeaker 304 and the fourth loudspeaker 306 such that a distance between the third loudspeaker 304 and the other feedback microphone M382 equals a distance between the fourth loudspeaker 306 and the other feedback microphone M382. Further, the distances between the other feedback microphone M382 and each of the third and fourth loudspeakers 304, 306 equal the distances between each of the third and fourth loudspeaker 304, 306 and the ANC target position. For example, the first and second loudspeakers 300, 302 may be part of a feedback loop including the feedback microphone M381, and the third and fourth loudspeakers 304, 306 may be included in another feedback loop further including the other feedback microphone M382. The ANC target position of both feedback loops may be equal as illustrated in FIG. 4, right side (e.g. entry of the ear canal). If both feedback loops are operated simultaneously, it may, however, be advantageous in some cases that the target position of the two feedback loops is not identical, as anti-noise signals of both loops may otherwise superimpose at a common ANC target position. This may lead to an over-compensation of the noise signal, which may further result in reduced noise suppression (as compared to a single feedback loop), or even a boost of noise. The reason for this is that the remote feedback microphones M381 and M382 may primarily receive signals from the loudspeaker that is arranged closer to the respective feedback microphone M381, M382. To avoid an over-compensation, the ANC target positions of both feedback loops may be chosen remotely from each other and remotely from the actual ANC target position of the complete ANC system (e.g. the ear canal entry in FIG. 4, right). These remote ANC target positions may, for example, be chosen such that the distance between each loudspeaker within a feedback loop and the respective remote target position equals half of the distance of each loudspeaker within that feedback loop to the actual ANC target position (e.g. entry of the ear canal).

The embodiments illustrated in FIG. 4 are merely examples. Any other number of loudspeakers and feedback microphones may be included in the arrangement. Generally speaking, a feedback microphone which is included in a feedback loop, the feedback loop including at least one loudspeaker, is arranged at a certain distance (free air path) from each of the at least one loudspeakers which equals the distance (free air path) between the respective loudspeaker and the ANC target position of the feedback loop. Likewise, a loudspeaker which is included in a feedback loop, the feedback loop including at least one feedback microphone, is arranged at a certain distance (free air path) from each of the at least one feedback microphones which equals the distance (free air path) between the respective loudspeaker and the ANC target position of the ANC feedback loop. Furthermore, each of the at least one loudspeakers included in the at least one feedback loop, the at least one feedback loop including at least one feedback microphone, is arranged at a certain distance (free air path) from each of the at least one feedback microphones within the at least one feedback loop, which equals the respective distance (free air path) of each of the at least one loudspeakers to the ANC target position of the at least one feedback loop. In this context it should be noted that multiple feedback loops may share one or more loudspeakers and/or one or more microphones in the sense that microphone signals may be utilized in multiple feedback loops, where these signals may optionally be summed to signals from other feedback microphones, and loudspeakers may receive control signals from multiple feedback loops such that the control signals from these feedback loops are summed ahead of or during application to the loudspeaker.

A similar situation regarding the relative placement of loudspeakers, feedback microphones and ANC target position can be found in active head rest systems which may be used for noise cancellation in cars. Such a head rest, as is exemplarily illustrated in FIG. 5, may comprise one or more loudspeakers as well as one or more feedback microphones for sensing a feedback signal. The ANC target positions are located at the ears (e.g., entrance of the ear canals) of the person that is seated on the respective car seat. In active head-rest applications, the distance between the ANC target position and the loudspeakers in the head rest is usually between about 5 cm and about 15 cm. If the feedback microphone is arranged too close to the loudspeaker, there is no anti-noise signal left at the ears of the user, as has been described above. In active head rest applications, it is very difficult or even almost impossible to provide a feedback microphone that is positioned close to the user's ear. A feedback microphone, however, may be placed at another position on the head rest. According to an example of the present disclosure, the position of at least one feedback microphone is chosen such that it is arranged on the same radius of a sphere around the loudspeaker used for anti-noise generation as one or both ears of the user. According to another embodiment, the position of at least one feedback microphone is chosen such that the length of a path through free air (acoustically unobstructed) which the sound emanated by a loudspeaker that is used for anti-noise generation has to travel until it reaches the at least one feedback microphone, is equal to the length of the path through free air, which the sound that is emanated by the loudspeaker used for anti-noise generation has to travel until it reaches the target ANC position.

Figure 5:
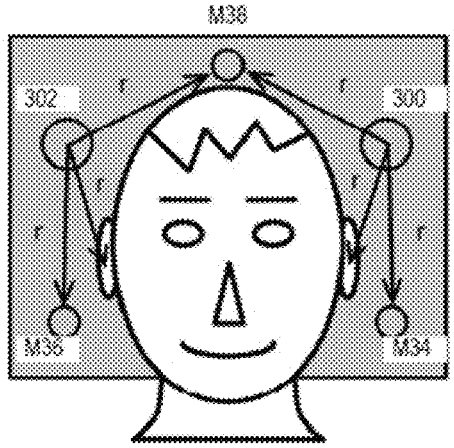
FIG. 5 schematically illustrates an active head-rest arrangement.

A head rest may comprise two loudspeakers 300, 302, for example, wherein one loudspeaker 300 is arranged at a first side of the user's head such that it is arranged closer to a first ear of the user than to a second ear of the user, and one loudspeaker 302 is arranged at a second side of the user's head such that it is arranged closer to the second ear of the user than to the first ear, as is illustrated in FIG. 5. In this way, one loudspeaker 302 may provide sound predominantly to the right ear of the user and the other loudspeaker 300 may provide sound predominantly to the left ear of the user. At least one feedback microphone M34, M36 may be provided for each loudspeaker 300, 302. The loudspeakers 300, 302 may be arranged at a first distance r from the respective ear of the user. The respective feedback microphones M34, M36 may be arranged on the head rest, wherein a distance r between the loudspeakers 300, 302 and the respective feedback microphone M34, M36 equals the distance between the loudspeakers 300, 302 and the respective ear of the user. This means that a third feedback microphone M34 may be arranged at a first distance r from the second loudspeaker 302, wherein a distance r between the second loudspeaker 302 and an ear of the user (e.g., the right ear) is the same as the first distance r. A fourth feedback microphone M36 may be arranged at a second distance r from the first loudspeaker 300, wherein a distance r between the first loudspeaker 300 and an ear of the user (e.g., the left ear) is the same as the second distance r. It is possible to provide separate feedback loops for both loudspeaker/microphone combinations (302/M34 and 300/M36). It is, however, also possible to sum up the output of both feedback microphones M34, M36 to generate a single feedback signal for both loudspeakers 300, 302.

In another example, a head rest comprises two loudspeakers 300, 302 (one for each ear of the user), but only one common feedback microphone M38. This common feedback microphone M38 may be arranged in between the two loudspeakers 300, 302. The distance r between the first loudspeaker 300 and the common feedback microphone M38 is essentially the same as the distance r between the second loudspeaker 302 and the common feedback microphone M38. The distance r between the common feedback microphone M38 and each of the loudspeakers 300, 302 essentially equals the distance r between each loudspeaker 300, 302 and the respective ear of the user.

Still referring to FIG. 5, according to a further example, a head-rest may comprise two loudspeakers 300, 302 (one for each ear of the user), a third feedback microphone M34, a fourth feedback microphone M36 and a fifth feedback microphone M38. The distance between the second loudspeaker 302 and the first ANC target position (right ear of the user), may equal the distance between the first loudspeaker 300 and the third and fifth feedback microphone M34, M38. Furthermore, the distance between the first loudspeaker 300 and the second ANC target position (left ear of the user), may equal the distance between the first loudspeaker 300 and the fourth and fifth feedback microphone M36, M38. The first loudspeaker 300 may be included in a first feedback loop, the first feedback loop further including the fourth feedback microphone M36 and the fifth feedback microphone M38. The ANC target position of the first feedback loop may be the left ear of the user. The second loudspeaker 302 is included within a second feedback loop, the second feedback loop further including the third feedback microphone M34 and the fifth feedback microphone M38. The ANC target position of the second feedback loop may be the right ear of the user.

As different persons generally have a different anatomy, the ears of different users may be arranged at different distances from the headrest and, therefore, from the loudspeakers and the microphones. However, such differences are generally in the range of only a few centimeters. Headrests may generally be adjusted in height. Therefore, the loudspeakers and microphones may be brought into the appropriate height for the present user of the system. Still, the ears of some users may be closer to the headrest than the ears of other users. Therefore, while the distance between the loudspeakers and the microphones remain constant, the distance between the ear (active noise control target position) and the loudspeaker may vary between different users. Therefore, the first distance (loudspeaker—active noise control target position) and the second distance (loudspeaker—microphone) may not be exactly equal, but at least essentially equal (deviation of only a fraction of the distance between the loudspeakers and the corresponding feedback microphones). However, as the size of a silent zone generated by a feedback loop arrangement increases with the distance between the ANC target position and the loudspeaker(s) radiating the anti-noise signal, the system may still provide adequate noise cancellation at the positions of the user's ears.

Throughout the description, a position of a loudspeaker may be defined by the acoustic center of the loudspeaker or by the geometric center of a membrane of the loudspeaker. That is, a distance between a loudspeaker and a feedback microphone may be the distance between the acoustic center of the loudspeaker and the feedback microphone or the distance between the geometric center of the membrane of the loudspeaker and the feedback microphone, for example.

According to one example of the present disclosure, a loudspeaker arrangement comprises a first loudspeaker configured to radiate an acoustical signal, and a first microphone that is acoustically coupled to the loudspeaker via a secondary path and that is electrically coupled to the loudspeaker via an active noise control processing unit. During the use of the loudspeaker arrangement, the first loudspeaker is arranged at a first distance from a first active noise control target position, wherein the active noise target position is the position at which noise is to be suppressed. The first microphone is arranged at a second distance from the first loudspeaker, and the first distance equals the second distance.

According to a further example, a loudspeaker arrangement comprises a first loudspeaker configured to radiate an acoustical signal, and a first microphone that is acoustically coupled to the first loudspeaker via a secondary path and that is electrically coupled to the first loudspeaker via an active noise control processing unit, wherein, during the use of the loudspeaker arrangement. The first loudspeaker in this example is arranged at a first distance from a first active noise control target position, wherein the first active noise control target position is a position at which noise is to be suppressed, and wherein the first distance is a length of the shortest path between the first loudspeaker and the first active noise control target position through free air. The first microphone is arranged at a second distance from the first loudspeaker, wherein the second distance is a length of the shortest path between the first loudspeaker and the first microphone through free air. The first distance equals the second distance, and the position of the first microphone is remote from the first active noise target position.

According to a further example, the loudspeaker arrangement further comprises a support structure configured to be arranged around an ear of the user, wherein the first loudspeaker and the first microphone are arranged on the support structure, and, when the support structure is arranged around an ear of the user, the support structure defines an open volume about the ear of the user.

According to a further example, when the support structure is arranged around an ear of the user, the first active noise control target position essentially equals the position of an entrance of the ear canal of the ear of the user.

According to a further example, the first loudspeaker and the first microphone are arranged in a head-rest within a vehicle, wherein when a user is seated in front of the head-rest, an ear of the user is arranged at a first distance from the first loudspeaker and the first microphone is arranged at a second distance from the first loudspeaker, and wherein the first distance essentially equals the second distance.

According to a further example, the loudspeaker arrangement further comprises a second loudspeaker, wherein a distance between the first loudspeaker and the first microphone approximately equals a distance between the second loudspeaker and the first microphone, and a distance between the second loudspeaker and the first microphone equals a distance between the second loudspeaker and at least one of, the first active noise control target position and a second active noise control target position.

According to a further example, at least one of the following may apply: the first loudspeaker and the second loudspeaker form a feedback loop, the feedback loop further comprising the first microphone, wherein the first and second loudspeakers are controlled by a first and second control signal emitted by the active noise control processing unit, the first and second control signal being equal at least over a limited frequency range; the first loudspeaker forms a feedback loop with the first microphone, wherein the feedback loop further comprises at least one active noise control processing unit; and the second loudspeaker forms a feedback loop with the first microphone, wherein the feedback loop further comprises at least one active noise control processing unit.

According to a further example, the first active noise control target position equals the second active noise control target position. According to an even further example, the loudspeaker arrangement further comprises at least one second microphone, wherein the at least one second microphone is arranged at a third distance from the first loudspeaker, and the third distance equals the first distance and the second distance.

According to a further example, at least one of the following may apply: the first loudspeaker forms a feedback loop with the first microphone, wherein the feedback loop further comprises an active noise control processing unit; the second loudspeaker forms a feedback loop with the first microphone, wherein the feedback loop further comprises an active noise control processing unit; the first loudspeaker forms a feedback loop with the first microphone and the second microphone, wherein signals received by the first and the second microphone are summed within an active noise control processing unit; the second loudspeaker forms a feedback loop with the first microphone and the second microphone, wherein signals received by the first and the second microphone are summed within an active noise control processing unit; the first loudspeaker and the second loudspeaker form a feedback loop with one of the first microphone and the second microphone, wherein the first and the second loudspeaker are controlled by a first and a second control signal emitted by an active noise control processing unit, the first and second control signal being equal at least over a limited frequency range; and the first loudspeaker and the second loudspeaker form a feedback loop with both of the first microphone (and the second microphone, wherein the signals received by the first and the second microphone are summed within an active noise control processing unit, and wherein the first and the second loudspeaker are controlled by a first and second control signal emitted by the signal conditioning and processing unit, the first and second control signals being equal at least over a limited frequency range.

According to a further example, a distance between the second microphone and the second loudspeaker equals the third distance. According to an even further example, the first loudspeaker forms one or more feedback loops with one or more of the microphones, wherein the feedback loop further comprises at least one active noise control processing unit.

According to a further example, the loudspeaker arrangement further comprises at least one further loudspeaker and at least one further microphone, wherein each loudspeaker forms a feedback loop with at least one of the microphones, and the loudspeaker of each feedback loop is arranged at a distance from the respective microphone which equals the distance between the respective loudspeaker and at least one of a first and a second ANC target position.

According to a further example, a method comprises radiating an acoustical signal at a first position, wherein a first active noise control target position is arranged at a first distance from the first position, wherein the active noise target position is the position at which noise is to be suppressed, and wherein the first distance is a length of the shortest path of the acoustical signal to the active noise control target position through free air. The method further comprises detecting sound at a second position, wherein the second position is arranged at a second distance from the first position, wherein the second distance is a length of the shortest path of the sound to the second position through free air, wherein the first distance equals the second distance, and the active noise control target position is remote from the second position.

According to a further example, the detected sound is a sum signal comprising a desired acoustical signal as well as an unwanted signal, and the method further comprises subtracting the sum signal from the desired acoustical signal to obtain information about the unwanted signal at the second position, wherein the unwanted signal has an amplitude and a phase.

According to a further example, the method further comprises generating a noise reducing signal which has the same amplitude and an opposing phase as compared to the unwanted signal such that the unwanted signal is at least partly cancelled out at the first active noise control target position.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as the signal processing components and sound sources discussed above. The methods may be performed by executing stored instructions with one or more logic devices (e.g., processors) in combination with one or more additional hardware elements, such as storage devices, memory, hardware network interfaces/antennas, switches, actuators, clock circuits, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

While various embodiments of the disclosure have been described, it will be apparent to those of ordinary skill in the art that many more embodiments and implementations are possible within the scope of the disclosure. Accordingly, the disclosure is not to be restricted except in light of the attached claims and their equivalents.

The invention claimed is:

1. A loudspeaker arrangement comprising:

a first loudspeaker configured to radiate an acoustical signal; and a first microphone that is acoustically coupled to the first loudspeaker via a secondary path and that is electrically coupled to the first loudspeaker via an active noise control processing unit, wherein, during use of the loudspeaker arrangement, the first loudspeaker is arranged at a first distance from a first active noise control target position, wherein the first active noise control target position is a position at which noise is to be suppressed, and wherein the first distance is a length of a shortest path between the first loudspeaker and the first active noise control target position through free air, the first microphone is arranged at a second distance from the first loudspeaker, wherein the second distance is a length of a shortest path between the first loudspeaker and the first microphone through free air, the first distance equals the second distance, and the position of the first microphone is remote from the first active noise target position, the loudspeaker arrangement further comprising a second loudspeaker, wherein:

a distance between the first loudspeaker and the first microphone approximately equals a distance between the second loudspeaker and the first microphone; and the distance between the second loudspeaker and the first microphone equals a distance between the second loudspeaker and at least one of the first active noise control target position and a second active noise control target position, and wherein at least one of:

the first loudspeaker and the second loudspeaker form a feedback loop, the feedback loop further comprising the first microphone, wherein the first and second loudspeakers are controlled by a first and second control signal emitted by the active noise control processing unit, the first and second control signals being equal at least over a limited frequency range;

the first loudspeaker forms a feedback loop with the first microphone, wherein the feedback loop further comprises at least one active noise control processing unit; and the second loudspeaker forms a feedback loop with the first microphone, wherein the feedback loop further comprises at least one active noise control processing unit.

2. The loudspeaker arrangement of claim 1, further comprising a support structure configured to be arranged around an ear of a user, wherein, the first loudspeaker and the first microphone are arranged on the support structure; and when the support structure is arranged around the ear of the user, the support structure defines an open volume about the ear of the user.

3. The loudspeaker arrangement of claim 2, wherein, when the support structure is arranged around the ear of the user, the first active noise control target position essentially equals a position of an entrance of an ear canal of the ear of the user.

4. The loudspeaker arrangement of claim 1, wherein the first loudspeaker and the first microphone are arranged in a head-rest within a vehicle; wherein when a user is seated in front of the head-rest, an ear of the user is arranged at the first distance from the first loudspeaker and the first microphone is arranged at the second distance from the first loudspeaker.

5. The loudspeaker arrangement of claim 1, wherein the first active noise control target position equals the second active noise control target position.

6. The loudspeaker arrangement of claim 1, further comprising at least one second microphone, wherein the at least one second microphone is arranged at a third distance from the first loudspeaker; and the third distance equals the first distance and the second distance.

7. The loudspeaker arrangement of claim 6, wherein at least one of the first loudspeaker forms a feedback loop with the first microphone and the second microphone, wherein signals received by the first and second microphones are summed within an active noise control processing unit;

the second loudspeaker forms a feedback loop with the first microphone and the second microphone, wherein the signals received by the first and second microphones are summed within an active noise control processing unit;

the first loudspeaker and the second loudspeaker form a feedback loop with the second microphone, wherein the first and second loudspeakers are controlled by a first and second control signal emitted by an active noise control processing unit, the first and second control signals being equal at least over a limited frequency range; and the first loudspeaker and the second loudspeaker form a feedback loop with both of the first microphone and the second microphone, wherein the signals received by the first and second microphones are summed within an active noise control processing unit, and wherein the first and second loudspeakers are controlled by a first and second control signal emitted by a signal conditioning and processing unit, the first and second control signals being equal at least over a limited frequency range.

8. The loudspeaker arrangement of claim 6, wherein a distance between the second microphone and the second loudspeaker equals the third distance.

9. The loudspeaker arrangement of claim 1, wherein the first loudspeaker forms one or more feedback loops with the microphone, and wherein at least one of the one or more feedback loops further comprises at least one active noise control processing unit.

10. The loudspeaker arrangement of claim 1, further comprising at least one further loudspeaker and at least one further microphone, wherein each loudspeaker forms a feedback loop with at least one of the microphones;

the loudspeaker of each feedback loop is arranged at a distance from the respective microphone which equals the distance between the respective loudspeaker and at least one of a first and second ANC target position.

11. A method comprising:

radiating an acoustical signal at a first position, wherein a first active noise control target position is arranged at a first distance from the first position, wherein the first active noise control target position is a position at which noise is to be suppressed, and wherein the first distance is a length of a shortest path of the acoustical signal to the first active noise control target position through free air; and detecting sound at a second position, wherein the second position is arranged at a second distance from the first position, wherein the second distance is a length of a shortest path of the sound to the second position through free air, wherein the first distance equals the second distance, and the first active noise control target position is remote from the second position, and the detected sound is a sum signal comprising a desired acoustical signal as well as an unwanted signal, the method further comprising:

subtracting the sum signal from the desired acoustical signal to obtain information about the unwanted signal at the second position, wherein the unwanted signal has an amplitude and a phase.

12. The method of claim 11, further comprising:

generating a noise reducing signal which has a same amplitude and an opposing phase as compared to the unwanted signal such that the unwanted signal is at least partly cancelled out at the first active noise control target position.

13. The method of claim 11, further comprising detecting sound at a third position, wherein the third position is arranged at a third distance from the first position, the third distance being equal to the first and second distances, and the third position being remote from the first active noise control target position and the second position.

14. The method of claim 13, further comprising adding a first sound signal detected at the second position to a second sound signal detected at the third position to generate a sum signal, and subtracting the sum signal from the desired acoustical signal to obtain a difference signal.

15. The method of claim 14, wherein radiating the acoustical signal comprises radiating the acoustical signal from a loudspeaker, the method further comprising filtering the difference signal to generate a filtered difference signal, and applying the filtered difference signal as a driving signal to the loudspeaker.

16. A loudspeaker system comprising:

a first loudspeaker configured to radiate an acoustical signal;

a first microphone that is acoustically coupled to the first loudspeaker via a secondary path and that is electrically coupled to the first loudspeaker via an active noise control processing unit; and the active noise control processing unit configured to generate a sum signal comprising a desired acoustical signal as well as an unwanted signal derived from sound detected by the first microphone, subtract the sum signal from the desired acoustical signal to generate a difference signal, filter the difference signal to generate a filtered difference signal, and apply the filtered difference signal as a driving signal to the first loudspeaker, wherein, during use of the loudspeaker system, the first loudspeaker is arranged at a first distance from a first active noise control target position, wherein the first active noise control target position is a position at which noise is to be suppressed, and wherein the first distance is a length of a shortest path between the first loudspeaker and the first active noise control target position through free air, the first microphone is arranged at a second distance from the first loudspeaker, wherein the second distance is a length of a shortest path between the first loudspeaker and the first microphone through free air, the first distance equals the second distance, and the position of the first microphone is remote from the first active noise target position, wherein the active noise control processing unit is further configured to add a first sound signal detected by the first microphone to a second sound signal detected at a second microphone to generate the sum signal, and subtracting the sum signal from the desired acoustical signal to obtain the difference signal, the second microphone being arranged at a third distance from the first loudspeaker, the third distance being equal to the first distance and the second distance, and the second microphone being remote from the first active noise control target position and the first microphone.

* * * * *